United States Patent [19]

Cox

[11] 4,292,901

[45] * Oct. 6, 1981

[54] CORNERBOARD FOR PALLETS

[76] Inventor: Clayton E. Cox, 1371 Eureka Canyon Rd., Watsonville, Calif. 95076

[ * ] Notice: The portion of the term of this patent subsequent to May 6, 1997, has been disclaimed.

[21] Appl. No.: 63,949

[22] Filed: Aug. 6, 1979

Related U.S. Application Data

[63] Continuation-in-part of Ser. No. 907,096, May 18, 1978, abandoned.

[51] Int. Cl.[3] ..... B65D 19/06

[52] U.S. Cl. ..... 108/55.1; 206/453; 206/586; 206/597

[58] Field of Search ..... 206/586, 587, 600, 453; 229/13 BT, DIG. 1; 108/13.1, 51.1, 53.5, 55.1, 55.5, 56.1, 56.3, 57.1; 52/301, 296; 211/43, 189

[56] References Cited

U.S. PATENT DOCUMENTS

| | | | |
|---|---|---|---|
| 1,200,467 | 10/1916 | Cady | 206/453 |
| 1,352,490 | 9/1920 | Wilkins | 211/189 |
| 1,682,060 | 8/1928 | Banks | 211/43 |
| 2,670,122 | 2/1954 | Davidson et al. | 206/586 |
| 2,948,624 | 8/1960 | Watson et al. | 220/8 |
| 3,349,984 | 10/1967 | Halko, Jr. | 206/586 |
| 3,887,102 | 6/1975 | Earley | 220/8 |
| 3,957,196 | 5/1976 | Kellerman | 206/586 |
| 4,201,138 | 5/1980 | Cox | 206/597 |

FOREIGN PATENT DOCUMENTS

| | | | |
|---|---|---|---|
| 690391 | 7/1964 | Canada | 52/301 |

*Primary Examiner*—Joseph Man-Fu Moy
*Attorney, Agent, or Firm*—Robert G. Slick

[57] ABSTRACT

A cornerboard for a pallet is provided which is fabricated from a suitable material; in one embodiment it is molded of a plastic and in another it is made of sheet steel sections. The cornerboards may be provided with a variety of interlocking sections and spacer members so that packages of different sizes can be accommodated by selecting the proper length of the sections and/or spacers.

6 Claims, 9 Drawing Figures

CORNERBOARD FOR PALLETS

REFERENCE TO RELATED APPLICATION

This application is a continuation-in-part of my application Ser. No. 907,096, filed May 18, 1978 now abandoned.

SUMMARY OF THE INVENTION

Many materials, such as frozen foods, are sold in relatively small cartons and in order to handle these expediously, they are placed on pallets. In order that the pallets can be handled and stored it is ordinarily necessary to provide some sort of corner structure for the palleted goods to keep the goods upright and to prevent them from sliding off the pallets.

In the past, it has been universal practice to hold goods by the use of ordinary boards. Two boards are nailed together at a right angle to form a corner pair and four of such corner pairs are placed at the corners of the loaded pallet and held together with some form of strap.

The cornerboards used in the past have not been fully satisfactory, primarily in that they do not properly protect the goods on the pallet. Such boards frequently allow the goods to sag so that much merchandise is lost. Further, the boards must be assembled by hand and cut to fit the particular load which is to be placed on the pallet.

In accordance with the present invention, an improved corner structure is provided for pallets which contain two or more interlocking sections together which may be used with spacer elements.

The corner structures of the present invention are much stronger than conventional boards so that better protection is given to the load and also act as load-bearing elements when pallets and their loads are stacked.

A further feature of the present invention is that the top section, and in some instances the bottom section as well, are provided with a cap which further protects the contents of the pallet.

Since the corner structures of the present invention may be made with a plurality of interlocking sections, loads of greatly varying size can be accommodated so that one can accommodate a variety of pallet loads with only a few standardized sections.

Preferably the corner structures of the present invention are made of a metal such as steel or a reinforced plastic so that they are much stronger than the corner structures used in the past.

Thus, the corner structures of the present invention allow one to accommodate a variety of loads with a relatively few standardized pieces and provide better protection for the loaded pallet than has heretofore been available.

Other features and advantages of the invention will be brought out in the balance of this application.

DESCRIPTION OF THE PREFERRED EMBODIMENTS

Figure 1:
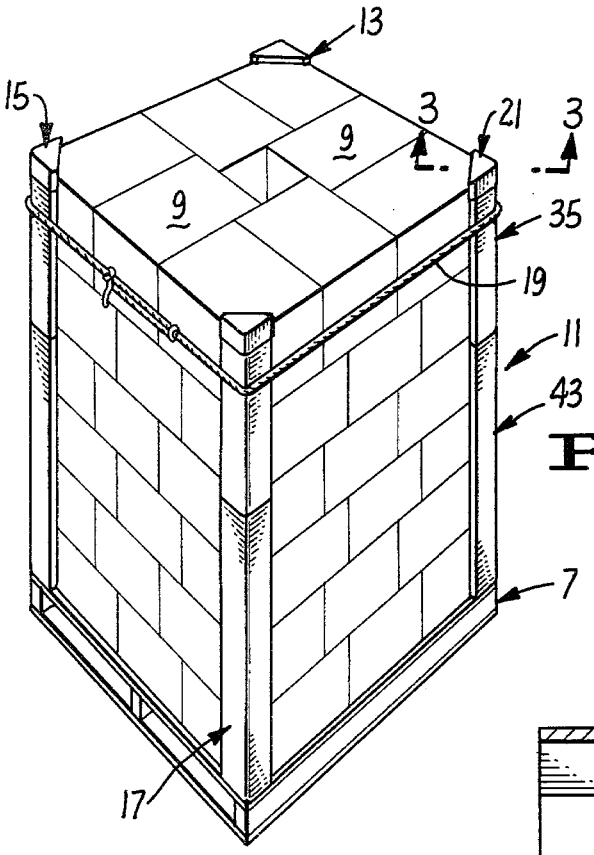
FIG. 1 is a perspective view of a loaded pallet utilizing corner structures embodying the present invention, said structures being preferably fabricated of a reinforced plastic.
Figure 2:
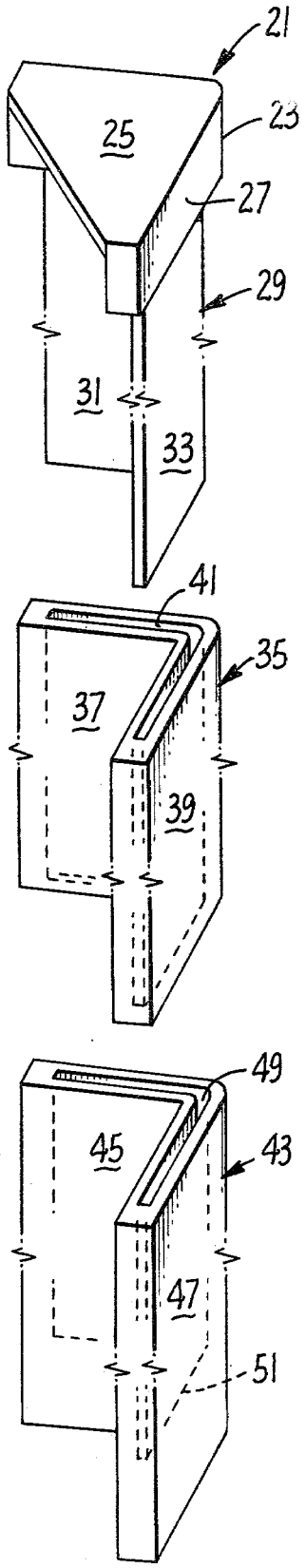
FIG. 2 is a perspective exploded view of a corner structure.
Figure 3:
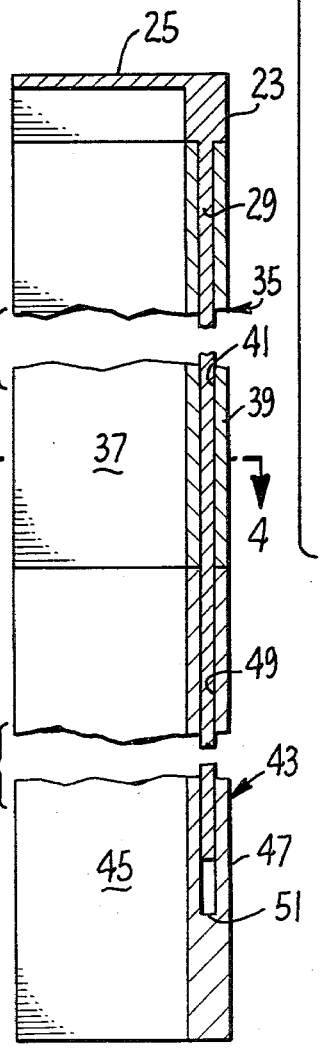
FIG. 3 is an enlarged section on the line 3—3 of FIG. 1.
Figure 4:
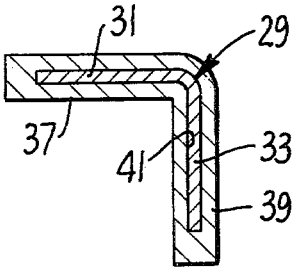
FIG. 4 is a section on the line 4—4 of FIG. 3.

Referring now to FIGS. 1-5 of the drawings by reference characters there is shown a pallet 7 having a load of boxes 9 thereon. The boxes 9 have a rectangular configuration and have been stacked to fit the pallet 7.

In accordance with the present invention four corner elements generally designated 11, 13, 15 and 17 are placed at the four corners of the loaded pallet and a flexible strap 19 is employed to hold the cornerboards together and maintain the pallet load in a desired configuration. Although only a single strap 19 has been shown, in many instances two or even more straps might be used around the load.

Since the four cornerboards are identical, only one will be described in detail. Thus, referring to FIGS. 2 through 4 the cornerboards included a top member generally designated 21. The member 21 has a top cap 23 which has a flat upper surface 25 so that the flat upper surface covers the corner of a pallet load. The top cap also includes a downwardly extending portion 27 which extends outwardly somewhat beyond the corner of the pallet. Also extending downwardly from the cap top cap 21 is the right angled fin 29 which includes the elements 31 and 33 which are formed at a right angle to each other. The elements 31 and 33 are formed of thin sections.

Below the top member 21 is a spacer member generally designated 35. This member has two walls 37 and 39 which are located at right angles to each other and formed within these walls is a right angle slot 41 which is complementary to the fin 29 so that the fin 29 can pass through this slot.

Situated below spacer element 35 is the bottom member generally designated 43. This member has two walls 45 and 47 with a slot 49 which is complementary to the fins 29. However, the slot 49 terminates short of the bottom as is shown at 51. Thus the bottom member 43 has a slot opening at the top but is solid at the bottom. Fin 29 passed down through slot 41 in member 35 and then into slot 49 in member 43.

Figure 5:
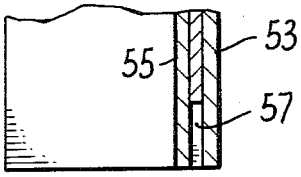
FIG. 5 is a section of an alternate form of bottom section.

In some instances, it would be desirable to provide a structure which permits the use of a member like the top member 21 on the bottom of the pallet. In such a situation, an intermediate member is provided as is shown in FIG. 5 having outer and inner walls 53 and 55 respectively with a slot 57 at the bottom. If such an intermediate member is used, it is obvious that a member such as that designated 21 could be inverted and used on the bottom of the stack.

One feature of the present invention is that members can be used interchangeably to provide for varying heights of stacks of goods piled on the pallet. Thus the member 35 could be higher or lower depending on the particular height of the goods piled on the pallet. For instance, one could use the members 21 and 43 on various loads on pallets by providing collars 35 of varying height. In fact, in some instances one could eliminate collar 35 altogether and merely use the top member 21 and the bottom member 43.

Another embodiment of the invention is shown in FIGS. 6–9. In this embodiment of the invention, the structural material is preferably sheet steel and the parts are fabricated by bending and welding operations. However, other construction materials may be used.

Figure 6:
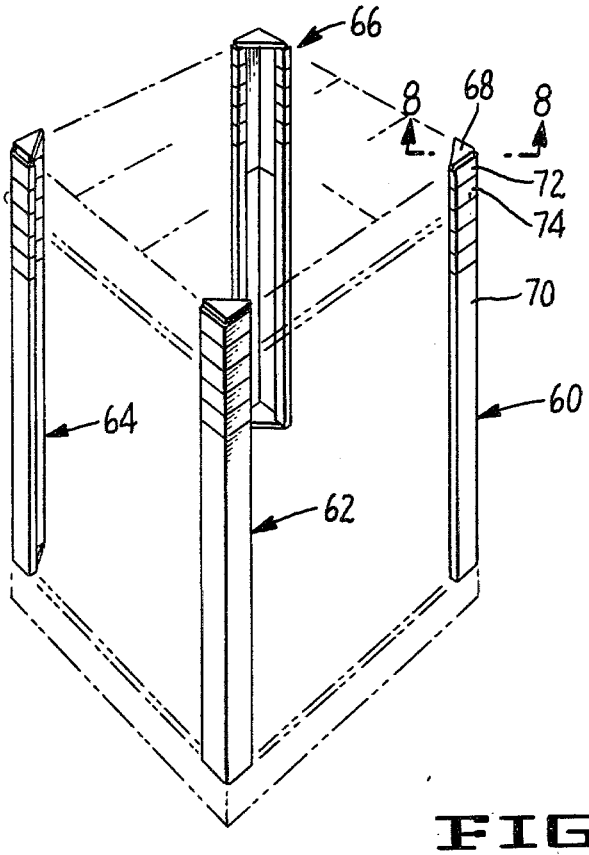
FIG. 6 is a perspective view of a loaded pallet utilizing another embodiment of the invention wherein the corner structure is fabricated from sheet steel.

In FIG. 6 a pallet is shown, as before, having four corner posts, generally designated 60, 62, 64 and 66. Since all of these posts are identical, only one is described in detail.

Figure 7:
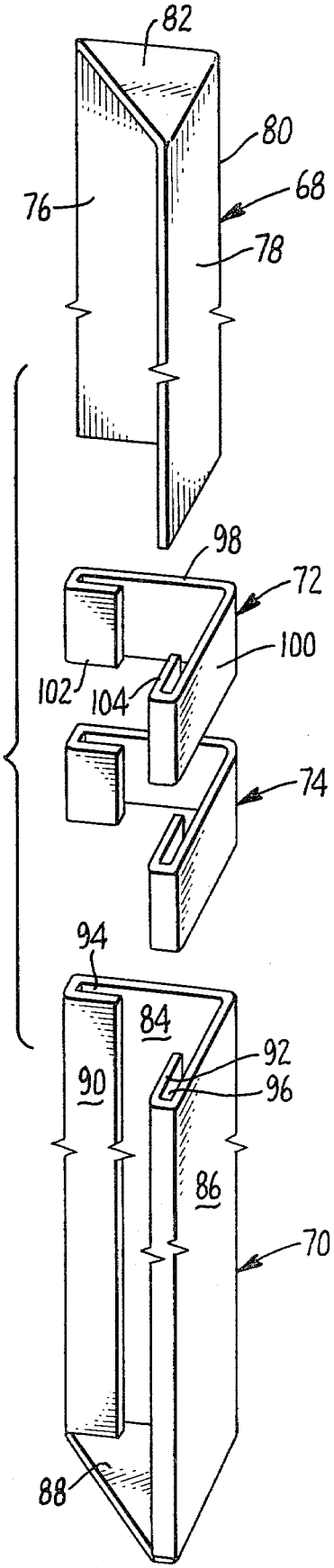
FIG. 7 is an enlarged, exploded view of one of the corner sections shown in FIG. 6.
Figure 9:
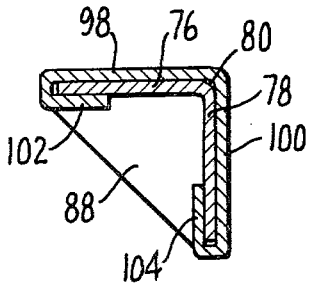
FIG. 9 is a section on the line 9—9 of FIG. 8.
Figure 8:
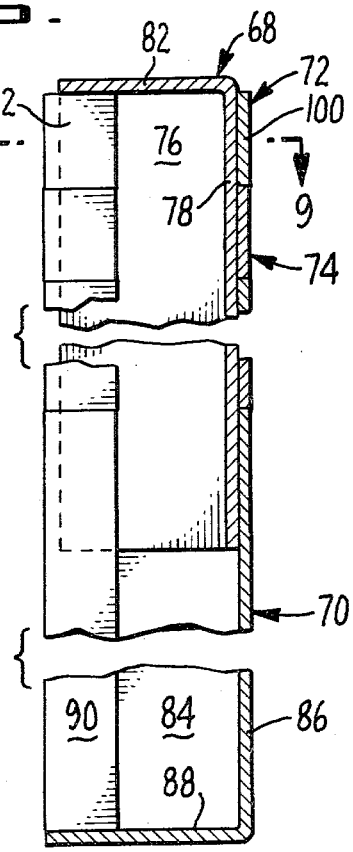
FIG. 8 is a sectional view on the line 8—8 of FIG. 6.

As is best shown in FIG. 7, the corner support consists of a top member, generally designated 68, and a bottom member, generally designated 70. Intermediate members may or may not be used and two are shown in FIG. 7, generally designated 72 and 74. The intermediate members 72 and 74 have been shown of equal height, but it is not necessary that they be of the same height and two or more members might be used of different heights.

Top member 68 consists of an angle iron, having the faces 76 and 78 forming a right angle to each other. These could be fabricated from two sheets welded along the junction 80 but normally they would be bent from a single sheet of steel. A top member 82 is fastened to a side member 76 and 78, preferably by welding.

The bottom member 70 is basically of the same structure having the side plates 84 and 86 which form a right angle to each other and which have a triangular bottom plate 88 corresponding to the top plate 82. The side plates 84 and 86 have inturned lips 90 and 92 respectively which form bights 94 and 96. The bights 94 and 96 are of a sufficient width to form a tight fit with the plates 76 and 78 and the inturned lips 90 and 92 are sufficiently long to support the plates 76 and 78 in a substantially rigid manner.

In many instances, the top member 68 and the bottom member 70 can be selected of a suitable size so that it is not necessary to use any intermediate spacer members. Thus, the side members 76 and 78 could be merely slipped into the bights 94 and 96 and pressed down over the corner of the pallet, it being understood, of course, that the corner structures would form load-bearing structures so that another pallet could be stacked on top of the one shown without compressing the contents of the pallet itself.

In order to provide for more versatility so that it is not necessary to fabricate the side members to the exact size needed, one or more intermediate spacer members such as 72 and 74 may be employed. Each spacer member consists of the sides 98 and 100 which are set at a right angle to each other. Inturned lips 102 and 104, corresponding to the inturned lips 90 and 86, are provided so that each of the spacer elements is of the same general structure as the bottom element except that it is shorter and does not have a bottom plate. As is shown best in FIG. 8, the spacers 72 and 74 are employed to build the corner post up to the desired height and to make a load-bearing structure of it so that any load from above is borne by the corner members and not by the load on the pallet.

Many variations can be made in the exact structure shown without departing from the spirit of this invention.

I claim:

1. A generally L-shaped corner structure for a pallet comprising in combination:

a. a top member 21 or 68, said member having a top cap 25 or 82 adapted to extend over the corner of a loaded pallet and having a thin L-shaped fin extending downward from said top cap, said L-shaped fin being composed of two thin flat elements 31 and 33 or 76 and 78 held at right angles to each other:

b. a bottom member 43 or 70 said bottom member having an L-shaped right angle configuration 47 or 86 to fit over the outside of the flat elements of said top member and having at least one inwardly extending member 45 or 90 and 92 to cover the edges and at least a portion of the inner surface of said side member by providing a bight (junction of 43 and 57) or 94 and 96 whereby c. said top member can telescope into said bottom member to form a load-supporting corner structure for pallet.

2. The structure of claim 1 wherein said bottom member has a plate bridging the sides of the flat elements.

3. The structure of claim 1 having in addition at least one intermediate member of the same configuration as the bottom member whereby the top member can pass through said intermediate member and extend down into the bottom member.

4. The structure of claim 1 wherein the bottom member includes a slot to completely enclose the flat elements of the top member.

5. The structure of claim 4 wherein the corner structure is fabricated of a reinforced plastic.

6. The structure of claim 1 wherein the inwardly extending lips of the bottom member leave a substantial portion of the inner surfaces of the flat elements exposed.

* * * * *